US009469388B2

(12) United States Patent
Olshan

(10) Patent No.: US 9,469,388 B2
(45) Date of Patent: Oct. 18, 2016

(54) LIQUID FLYER, FLEXI UNDERWATER RAFT

(71) Applicant: Jeffrey Ashi Olshan, Santa Rosa, CA (US)

(72) Inventor: Jeffrey Ashi Olshan, Santa Rosa, CA (US)

( * ) Notice: Subject to any disclaimer, the term of this patent is extended or adjusted under 35 U.S.C. 154(b) by 0 days.

(21) Appl. No.: 14/214,802

(22) Filed: Mar. 15, 2014

(65) Prior Publication Data

US 2015/0259051 A1 Sep. 17, 2015

(51) Int. Cl.

| | |
|---|---|
| ***B63C 9/08*** | (2006.01) |
| ***A63B 31/00*** | (2006.01) |
| *B63B 35/73* | (2006.01) |

(52) U.S. Cl.

CPC ..... *B63C 9/081* (2013.01); *A63B 31/00* (2013.01); *A63B 2208/03* (2013.01); *A63B 2225/605* (2013.01); *B63B 2035/737* (2013.01)

(58) Field of Classification Search

CPC ..... B63B 35/74
USPC ..... 441/129–132
See application file for complete search history.

(56) References Cited

U.S. PATENT DOCUMENTS

| | | | | |
|---|---|---|---|---|
| 292,281 | A * | 1/1884 | Brewster | B63C 9/26 441/84 |
| 2,068,134 | A | 1/1937 | Houghton | |
| 2,939,156 | A | 6/1960 | Baker | |
| 3,561,652 | A * | 2/1971 | Ruter | A01K 65/00 224/103 |
| 3,877,096 | A * | 4/1975 | Scesney | B63C 9/20 116/209 |
| 5,176,554 | A | 1/1993 | Simmons | |
| 5,520,561 | A * | 5/1996 | Langenohl | B63B 35/78 441/129 |
| 5,571,036 | A * | 11/1996 | Hannigan | B63B 35/78 441/129 |
| 5,628,658 | A * | 5/1997 | Clifford | A47C 15/006 441/130 |
| D422,331 | S | 4/2000 | Ponce de Leon | |
| 7,364,486 | B2 * | 4/2008 | Serpa | B63B 7/04 441/80 |
| D655,364 | S | 3/2012 | Johnston | |
| 8,408,959 | B2 * | 4/2013 | Wickham | B63C 9/082 441/84 |
| 2004/0072484 | A1 * | 4/2004 | Howerton | B63B 35/78 441/132 |

* cited by examiner

*Primary Examiner* — S. Joseph Morano
*Assistant Examiner* — Jovon Hayes

(57) ABSTRACT

The Liquid Flyer Flexi Underwater Raft is a unique, convertible, floatation device that allows one or more people to float horizontally underwater with heads and feet above water. It was designed for relaxed meditative floatation, water play, pain relief, and life-saving purposes, determined by which configuration the user puts it into. It is comprised of six 22-inch members of hollow-core extruded closed-cell polyethylene foam (water noodles), connected via nylon or polyester rope of high tensile strength, that is threaded through originally designed resin end caps, affixed to both ends of each foam member to prevent the rope from tearing the foam. The rope is tied and knotted internally within one member for the appearance of having an invisible seam. When compared to other recreational and life saving similar devices, the Liquid Flyer has many more advantages, as spelled out in this document.

1 Claim, 10 Drawing Sheets

FIG. 5
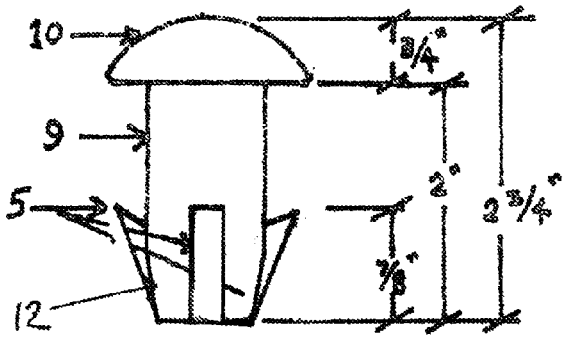
FIG. 7
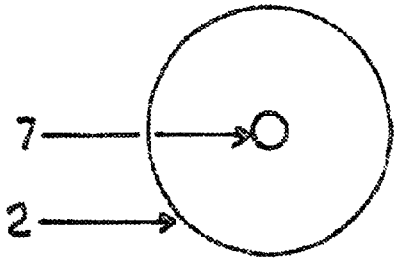
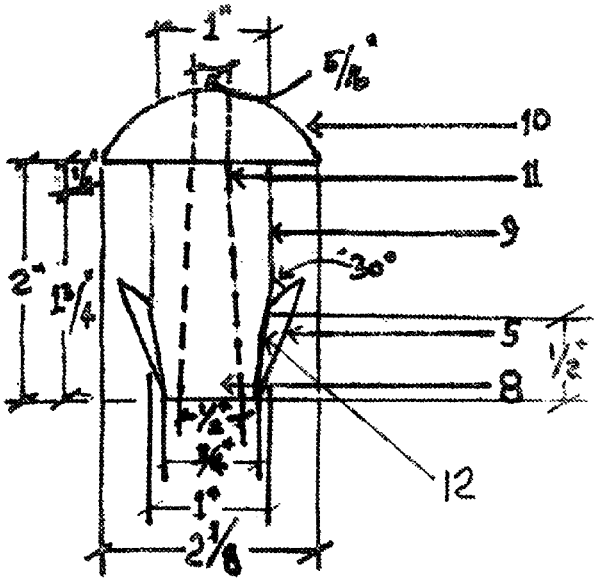
FIG. 4
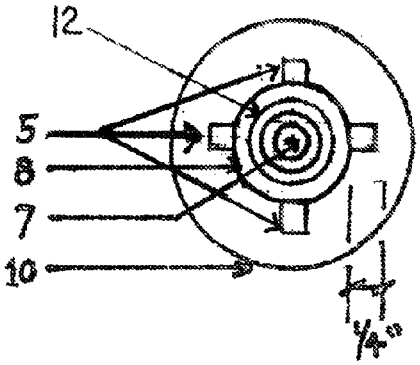
FIG. 6

FIG. 9
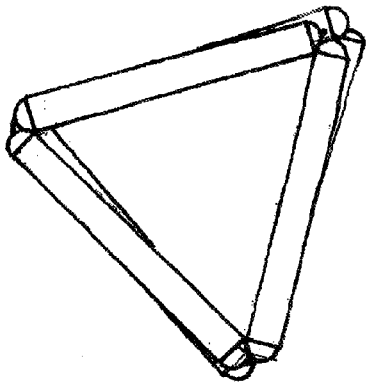
FIG. 10
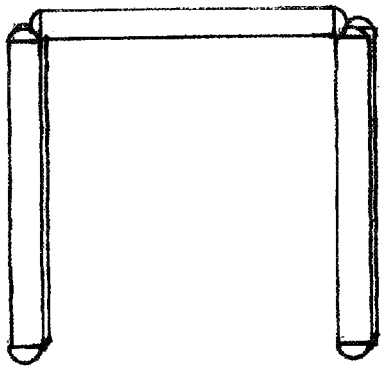
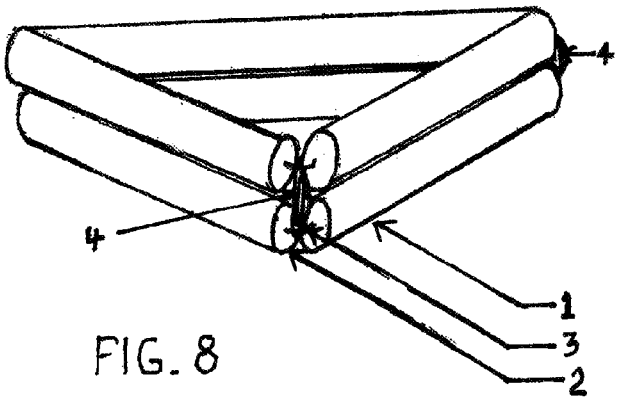
FIG. 8
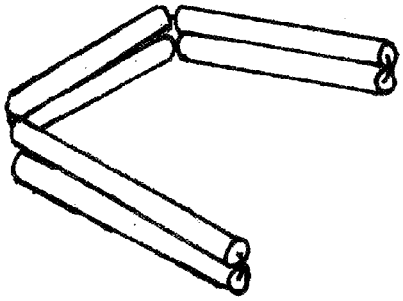
FIG. 11

FIG. 12
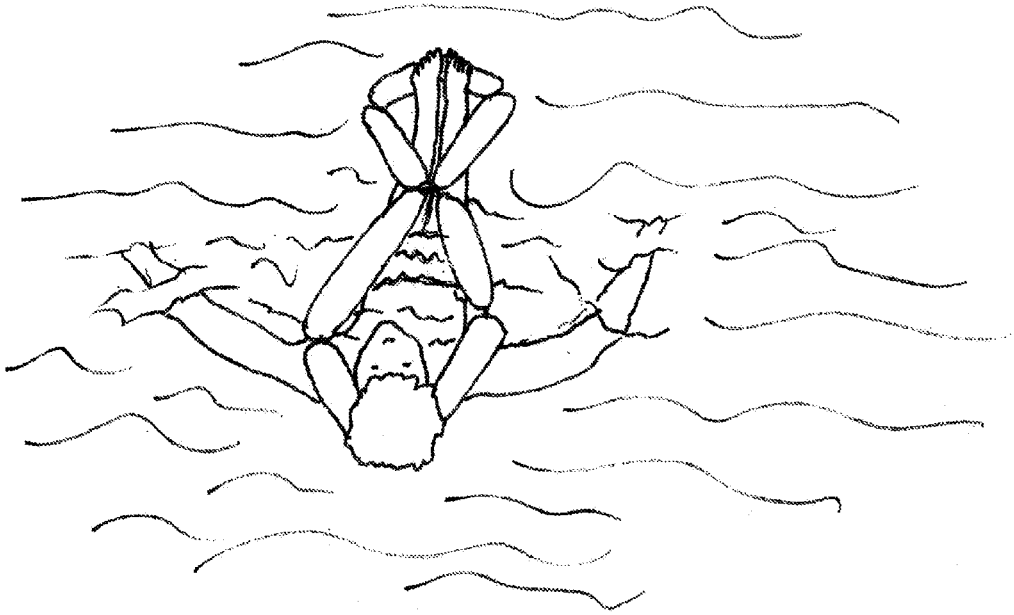
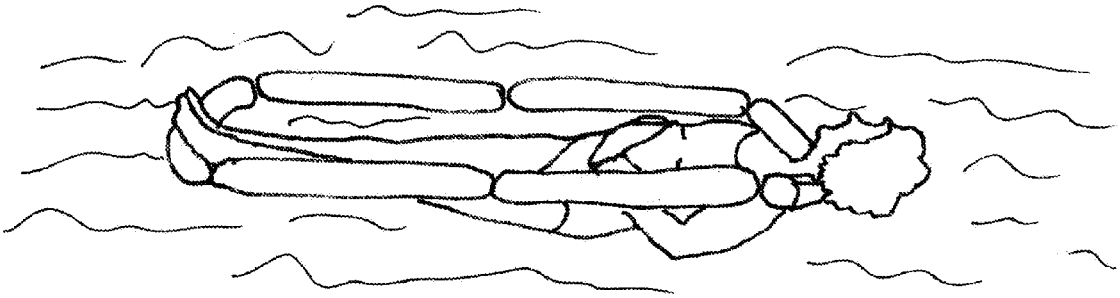
FIG. 13

FIG. 16
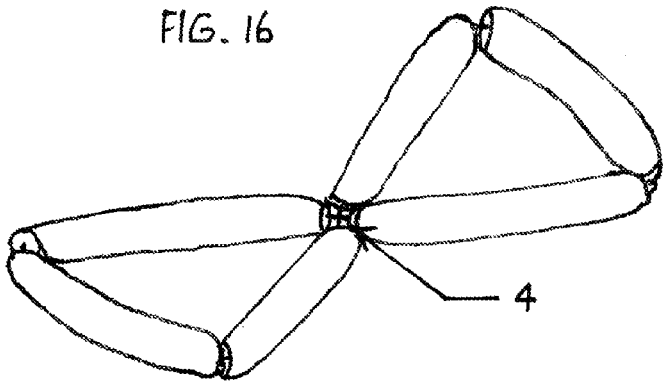
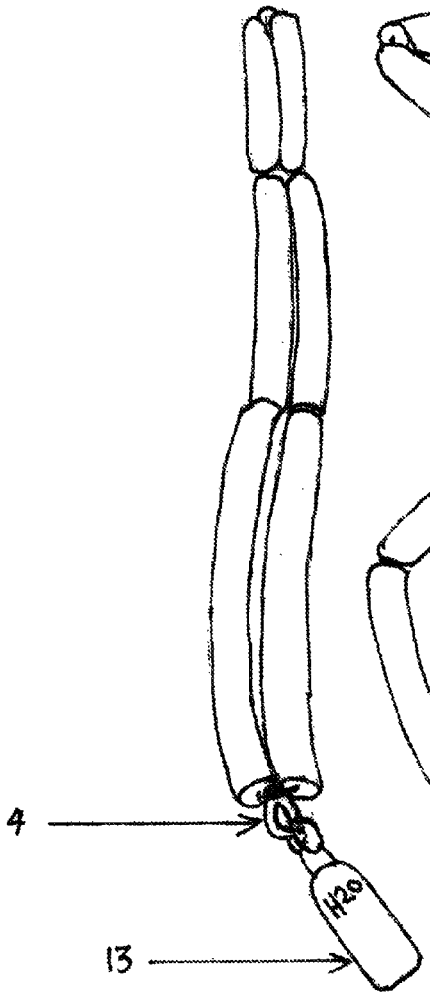
FIG. 14
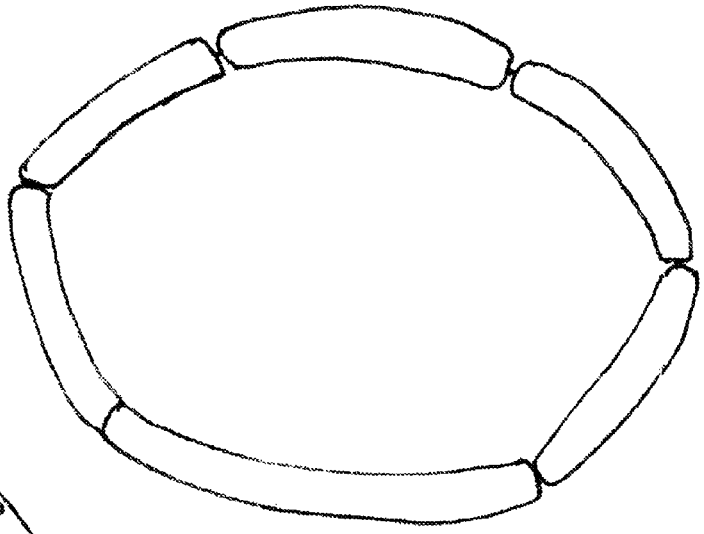
FIG. 15

LIQUID FLYER, FLEXI UNDERWATER RAFT

This application claims the benefit of Non Provisional application Ser. No. 14/214,802 filed Mar. 15, 2014, for the invention "Liquid Flyer Flexi Underwater Raft"—formerly named "Head's Up! Convertible Underwater Raft" in Provisional Application No. 61/787,602 filed on Mar. 15, 2013—by Jeffrey Ashi Olshan, a citizen of the United States, who resides in Santa Rosa, Calif.

STATEMENT REGARDING FEDERALLY SPONSORED RESEARCH

Not applicable.

REFERENCE TO SEQUENCE LISTING, ETC

Not applicable.

BACKGROUND OF THE INVENTION

This section provides background information related to the present disclosure of a multi-functional, convertible, underwater raft titled "Liquid Flyer Flexi Underwater Raft"—AKA "Liquid Flyer"—for use by one or more people for the purposes of: recreation, relaxation, aquatic exercise, physical therapies, life saving and a variety of original active and inactive meditations done in water, as prescribed in the book authored by Liquid Flyer's inventor, titled *Meditations in Water*. Liquid Flyer Flexi Underwater Raft can be safely used in all bodies of water: bath tubs, hot tubs, pools, lakes, rivers and oceans. The multi-functional convertible Liquid Flyer allows one or more people to float fully submerged in the water with only head and feet or face and toes above water, while it can also facilitate floating above water as well. When employed as a meditation raft, as prescribed in *Meditations in Water*, this—companion to the book—convertible underwater raft is particularly helpful for aging or achy human bodies and those with physical impairments, because sitting to meditate on a firm surface with the force of gravity is often uncomfortable or impossible for some people to do painlessly, while meditating in water supported by LIQUID FLYER—because gravity is replaced by the buoyancy of the water—meditating in water is pain-free, refreshing and comfortable; words not usually associated with meditation. LIQUID FLYER is lightweight, compact, easily transported and stored, and totally toss-able for life saving purposes, while if presents seven advantages over the standard life saving ring buoy normally used for water rescue: 1) costs less, 2) lighter weight, 3) needs less storage space, 4) can float 'unconscious' rescue victims until rescued—not requiring them to hold on, 5) can float people above or below water as needed for exposure safety, 6) safer to toss because it cannot render rescue victims unconscious if they are accidentally hit in the head or neck by the tossed Liquid Flyer, while a ring buoy could render someone unconscious if hit by it, and 7) Liquid Flyer is versatile, not just employed for life saving, so more desirable to have on private boats, cruise ships and yachts.

The Liquid Flyer can be used as: a meditation aid; water toy; a lifesaving device; a floatation device for patients in rehabilitation therapy; and for pain relief for burn survivors by floating them in a liquid environment, under medically approved conditions. It is lightweight, compact, toss-able, and easily transported and stored.

I accomplish this by assembling the Liquid Flyer through our identified structural components, without mattress-style slabs or inflatable parts—which can be easily punctured and/or lose buoyancy. U.S. Pat. No. 2,068,134 (Cite1) and U.S. Pat. No. 2,939,158 (Cite2) are examples of water mattresses composed of flexible air-impermeable materials like vinyl plastic. My invention eliminates the concerns and risks of under- and over-inflation in these designs.

This invention falls into the categories of: water flotation devices; water toys (I have watched children play extensively in pools with a prototype of Liquid Flyer); devices for comfortable meditations (in water); and life-saving devices. The USPTO Class definition for Class 441 buoys, rafts, and aquatic devices includes "other aquatic devices." It is noted that rafts, Subclass 35, are buoyant devices "free floating, of shallow draft and little free board," and usually have platforms or floors for supporting the user. Our Liquid Flyer has no floor or platform and, therefore, falls outside the strict definition of raft under this classification, but buoyancy and its use in water still validate Class 441.

Under Class 441, Subclass 129—body supporting buoyant device—may be appropriate for the Liquid Flyer because it is a recreational and a generally slow-moving device, although it is designed for use by more than one person at a time (not just one). Alternatively, Subclass 136 might be used, which is provided for aquatic devices not specifically provided for elsewhere in the schedule. The author has reviewed patents falling under Class D21—games, toys and sports goods—Subclass 803, for swimming and devices to aid propulsion or floating the body. As a floating toy for children, it could be classified as D21/803.

I see similar art in design patent D655,364S (Cite3) from Mar. 6, 2012, U.S. Classification D21/805, for a buoyant assistive device in which there appears to be a curved foam member, with a strap running through it, used for support around the torso. Another design patent from Apr. 4, 2000, is D422,331 (Cite4), wherein a floatation device is created from what appears to be flexible foam members, in a shape similar to but not actually comprising a figure eight, under U.S. classification D21/803. Neither of these devices offers the convertibility of the Liquid Flyer.

The search for prior art reveals the drawings of U.S. Pat. No. 5,571,036 (Cite5) from Nov. 5, 1996, wherein buoyant flexible foam tubes are used in a "U" shape along with mesh or other fabric means to hold the "U" shape and provide floatation support of the head and chest allowing the body to be only partially submerged. That device is described as a "Flexible Tube Floating Sling" where a person can lie supine or prone, but their lower body half remains under water, and their head remains up on the sling. That patent provides improved stability over a flat floating mattress, because it provides a lower center of gravity to help keep a body stable on the sling. Unlike the Liquid Flyer, the body is still pressed against a platform.

The Liquid Flyer Flexi Underwater Raft is the first convertible underwater raft to allow more than one person to float together with their entire bodies horizontally under the water while their heads and feet—or just faces and toes—stay above water. No other raft or flotation device allows more than one person to do this, nor are their any floatation devices with the same capacity for the many functions that Liquid Flyer's convertible characteristic can perform. I cite U.S. Pat. No. 5,176,554 (Cite 6) dated Jan. 5, 1993, for a buoyant aquatic recliner that allows only one body to be submerged under the water in differing reclining positions. In that art, the described device comprises a torso supporting section, a thigh supporting section, and a lower leg supporting section. It can be adjusted to achieve a preferred body position by releasable attachment methodology. Each supporting section is comprised of a "pair of elongated substantially rigid and inelastic side members," which could make the device heavier and harder to manage, as the user attempts to "adjust his position in the water by adjusting, preferably in unison, the location of each flotation member along the sides of each body supporting section." In said device, adding or subtracting floatation members to the sides of the "body supporting section" could also adjust buoyancy to accommodate differing body weights. Liquid Flyer Flexi Underwater Raft improves on that device with the availability of noodle technology coupled with my original end caps, while accommodating more than one person when desired.

Additionally, the Liquid Flyer is convertible and can be employed and deployed in a variety of configurations for the purposes of all prior mentioned uses. The Liquid Flyer can be used in all of the following configurations for multiple functions: rectangle (FIGS. 1, 13, 20) for floating one or more people horizontally; circle or hexagon (FIG. 15) can float two adults and one child or as many as six people with only their feet up on Liquid Flyer; triangle (FIGS. 8-9) to vertically support or toss—for life saving—one to three people with heads upright and legs below water surface, or to be used as a swimming tube substitute; a figure-8 (FIGS. 12 & 16) when a carabiner clip is used to hook it together in the middle, which can also float a person above water by placing the clipped together sides junction below the body rather than over the person's body; open armchair (FIGS. 10-11)—'U' shaped folded in half—with three members resting on top of three members; in the closed-arm-chair (FIG. 21)—as a square—allowing user to keep ears above water, also used for one person to be supported for relaxation, meditation or life saving purposes where the rescue victim need not remain conscious until rescued; in a two by two straight line of three doubled-up members (FIG. 14) it is used for recreation, exercise, or can float up to three people for lifesaving.

The Liquid Flyer is inherently buoyant because the foam noodles it employs for its soft foam members are manufactured from unique closed-cell, extruded polyethylene foam that floats and resists water absorption. Constructed from the world's largest-selling water toy, swimming pool noodles, Liquid Flyer removes the discomfort some people experience when their bodies are resting on inflatable vinyl plastic floatation products which can be hot to the touch on sunny days and stick to the skin rather than allow the skin to move friction free across the floatation device. The Liquid Flyer's foam noodle members are easy on the skin, durable, and will not puncture. While water noodles are seen available for use at many swimming pool facilities, public and private (such as the YMCA), a person must hold onto a single noodle for support. Liquid Flyer improves this art by allowing one and more individuals to rest in a lying supine position with only head and feet or ankles resting on the Liquid Flyer, so that even if that individual falls asleep, s/he is completely supported and will not fall out or roll off. This invention offers another alternative to improving health, while it is the companion purchase for the inventor's original book—authored by the inventor—a totally new healing arts form known as *Meditations in Water.*

BRIEF SUMMARY OF THE INVENTION

The Liquid Flyer Flexi Underwater Raft was originally designed for use with the soon to be published book titled, "*Meditations in Water*"—formerly titled, *Zen Liquid Flying, Meditations in Water*, authored by Jeffrey Ashi Olshan, the inventor of Liquid Flyer. The Liquid Flyer is a convertible, multi-functional, underwater raft that is capable of being deployed in all bodies of water: bath tubs, hot tubs, pools, lakes, rivers and oceans; and floating in different configurations while serving 'multiple' purposes beyond meditation, including but not limited to: recreation, relaxation, aquatic exercise, physical therapies, life saving and a variety of original active and inactive meditations done in water, as prescribed in the inventor's book *Meditations in Water*. The multi-functional convertible Liquid Flyer allows one or more people to float fully submerged in the water together, rather than just one person at a time. Liquid Flyer allows people to float with only their heads and feet or faces and toes above water, while it can also facilitate floating above water in certain configurations. The number of configurations keeps growing as we keep discovering more, so the configurations mentioned in this paper are what the Liquid Flyer can do, but it is not limited to just these mentioned configuration nor is its functionality limited to just the areas thus far mentioned.

When not in use while floating independently on water, the Liquid Flyer will often take on the shape of a circular hexagon comprised of six 22" length round foam (cut hollow swim noodle) members, each with at least a 2⅜" diameter, a ¾ inch hollow center running its full length and connected together by an unseen, internal UV protected polyester nylon industrial ¼ inch diameter rope. Each 22" noodle member is capped on both ends with a novel fabricated self-locking resin end cap to protect the foam from tearing as the rope exerts pressure on the foam members when human bodies are resting on Liquid Flyer, in it, or clinging to it. The novel self-locking end caps require no adhesive to remain fixed and will not dislodge from the foam members under normal use. When the end caps are in place at the ends of each 22" member, a rope cut to 12-foot 8-inches in length is threaded through each member, and through both end caps on the two ends of each foam member, consecutively tied, and the knot hidden inside one of the six members, creating a seamless appearance. Two carabiner clips come clipped onto each Liquid Flyer to support the figure eight, triangle, closed arm-chair and other configurations. The carabiner clips simultaneously serve to attach a water bottle, sun lotion and/or an external rope when needed to attach to other Liquid Flyers or a fixed structure for the purposes of not drifting away.

For storage and transportation, the Liquid Flyer folds into one neat package of 24 inches long by a diameter of 9 inches and is carried in a light weight waterproof tote bag, all weighing less than two pounds, for easy transport and protection of the raft.

BRIEF DESCRIPTION OF THE SEVERAL VIEWS OF THE DRAWINGS

| FIG. # | Description of Drawings | Changes in drawing |
|---|---|---|
|
FIG. 4: | Interior end cap detail with dimensions | Annotated Sheet |
|
FIG. 5: | Exterior end cap detail with dimensions | Annotated Sheet |
|
FIG. 6: | Bottom view of end cap | Annotated Sheet |
|
FIG. 7: | Top view of end cap | Annotated Sheet |

-continued

Figure 17:
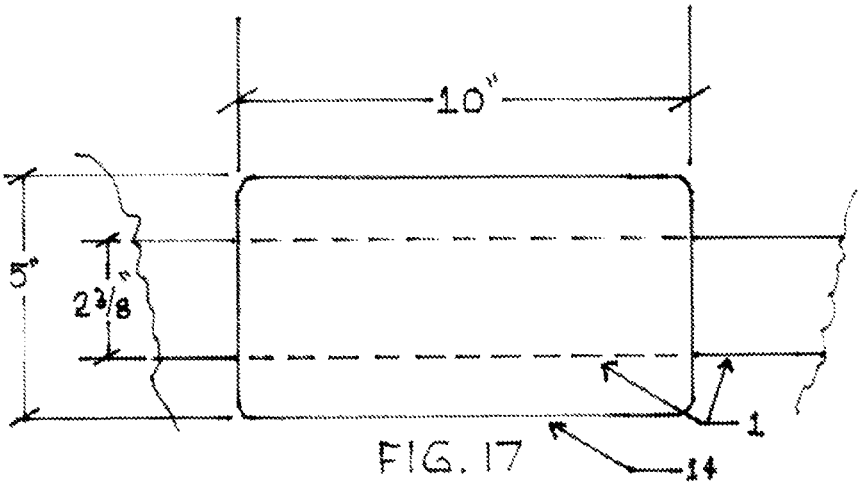
Figure 18:
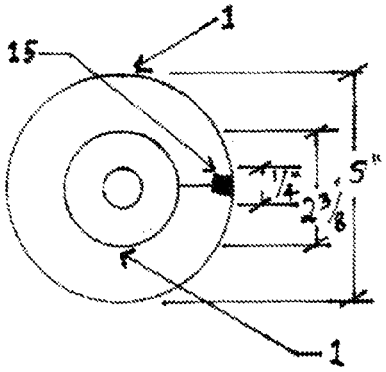
Figure 19:
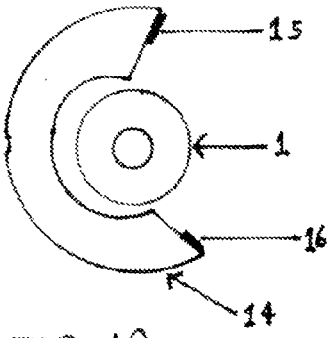
Figure 20:
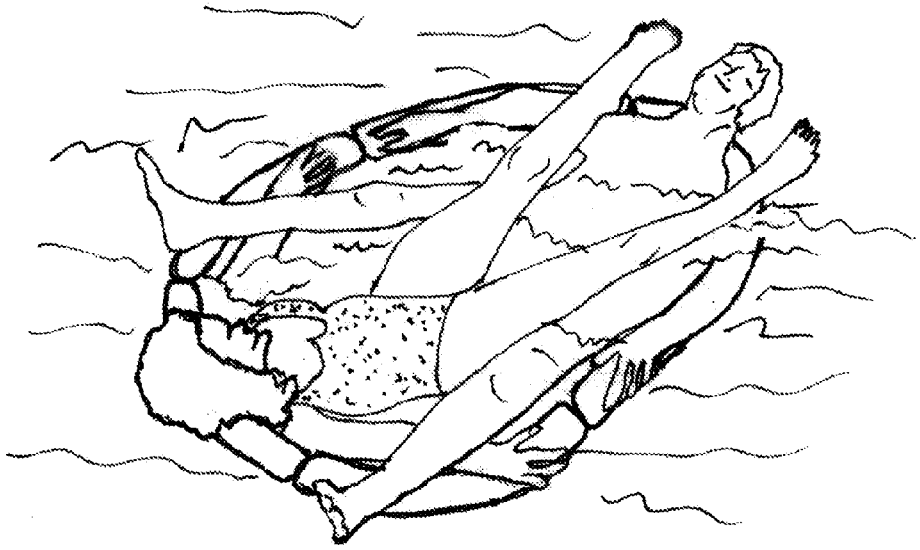
Figure 21:
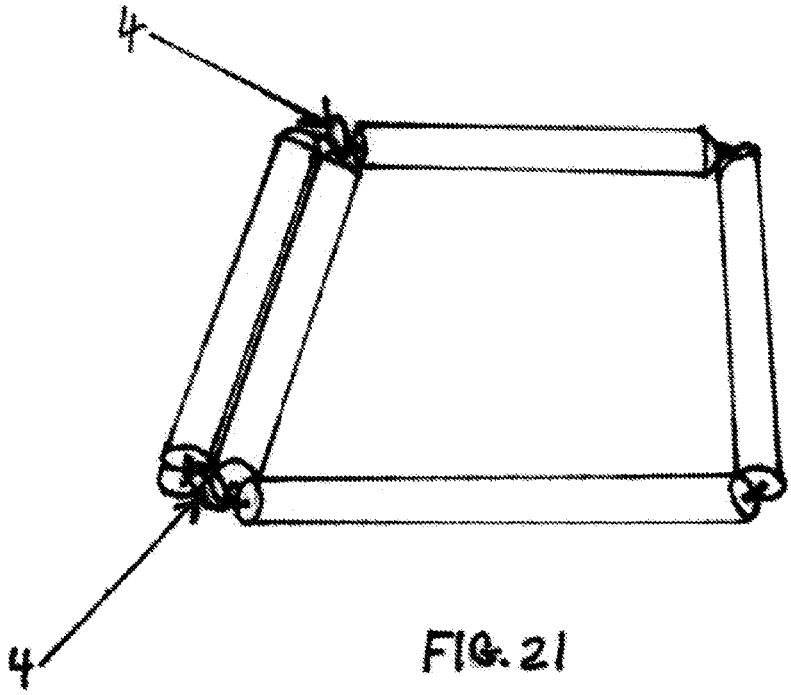

| FIG. # | Description of Drawings | Changes in drawing |
|---|---|---|
| FIG. 8: | Perspective of triangle configuration | Replacement Sheet |
| FIG. 9: | Top view of triangle configuration | Replacement Sheet |
| FIG. 10: | Top view of open armchair configuration | Replacement Sheet |
| FIG. 11: | Perspective view of open armchair configuration | Replacement Sheet |
| FIG. 12: | Perspective view of FIG. 8 configuration used by one person | Replacement Sheet |
| FIG. 13: | Perspective view of rectangle configuration being used by one person | Replacement Sheet |
| FIG. 14: | Perspective view of doubled-up three-member line with carabiner clip and water bottle | Replacement Sheet |
| FIG. 15: | Perspective view of circular hexagon configuration | Replacement Sheet |
| FIG. 16: | Perspective view of FIG. 8 configuration created by using one carabiner clip | Replacement Sheet |
| FIG. 17: | Optional Headrest attached to foam member of raft | Replacement Sheet |
| FIG. 18: | Cross section of optional headrest mounted on foam member | Replacement Sheet |
| FIG. 19: | Cross section of optional headrest in open position | Replacement Sheet |
| FIG. 20: | Perspective of two people in Liquid Flyer | Replacement Sheet |
| FIG. 21: | Perspective of closed armchair configuration; Allows ears to stay above water without headrest | New Sheet |
| FIG. 22: | Folded configuration for storage, transport or pillow use. | New Sheet |
| FIG. 23: | Folded while in tote bag for transport or use as a pillow | New Sheet |

DETAILED DESCRIPTION OF THE INVENTION

The Liquid Flyer Flexi Underwater Raft has multiple advantages over prior art in this field. 1) Comprised of hollow center extruded polyethylene foam (also known as swim noodles), it is not inflatable so it does not puncture or deflate, hence, Liquid Flyer cannot sink. 2) It allows one or more people to float horizontally under water with only head and feet or face and toes held above water; though over water floating is also possible with some configurations. 3) When compared to floating on a standard water raft, the Liquid Flyer raft allows for no contact or pressure against the body, so there is no stress on the body due to resting against a solid bottom. This means that people who suffer from back, leg, or arm pain, or any joint discomfort, or from severe body burns can enjoy pain-free floating, because there is no gravity or pressure on the back, buttocks, legs, or arms. 4) With arms hanging comfortably below, one or more people can paddle their way around in the water, moving and turning at will. When compared to standard float-on-top rafts or when seated in an inner tube, paddling the Liquid Flyer is less strenuous and more effective. 5) With supervision and assistance getting into and out of the water, some handicapped individuals can enjoy floating or meditating in water. 6) The Liquid Flyer can be used for some water therapy rehabilitation purposes. 7) As a life-saving device, when compared to ring buoys, it can support more than one person and can allow an unconscious person or persons to remain afloat without having to hold on until rescued. Because of its soft nature, if a water rescue victim were to be hit by a Liquid Flyer when tossed from a ship it would not hurt them. Where as a ring buoy is heavy and solid and could, conceivably, knock out a rescue victim if that person were to be hit in the head or neck. The Liquid Flyer weighs less for nautical weight considerations and costs less to purchase. 8) As a floating meditation device, when compared to a standard one-person floating raft, it allows the ears to be submerged to muffle out environmental sounds in meditation configurations, while Liquid Flyer allows ears to remain above water in other configurations—when desired. 9) It allows people to float without their bodies being on display—which is what standard inflatable rafts do; which is of concern to people who are over weight or concerned about body size, and of concern to keep the wet bather from getting wind chill. 10) It is a multi-functional, convertible, non inflatable floatation device employed for a variety of healthy and recreational uses; for physical therapy and for the prescribed unique, original meditations in water as prescribed in the inventor's authored book, Meditations in Water, scheduled for publication in August 2015. The Liquid Flyer is a companion item to be sold with the book.

The product size developed here generally fits most people between the heights of four feet and seven feet—due to the flexible, forgiving side members of the Liquid Flyer and use of carabiner clips to create the configuration needed. For purposes of clarity, I submit this standard size, while I will be producing it in many different sizes, until I learn what the market prefers. For custom sizes, instructions will also be furnished to allow a customer to create a custom fit for his or her own raft size.

When folded for storage or transport, it is 24 inches in length (six 22-inch foam members, held side-by-side and allowing for the end cap thickness and rope on each end)—with a diameter of 9 inches when in a cylindrical tote bag. (The tote bag may be substituted with an 8 inch wide waterproof band around the mid section of the Liquid Flyer held together with Velcro®.)

The Liquid Flyer as described herein, with two 2¾ inch carabiner clips attached, weighs 1 pound, 10.46 ounces or 26.46 ounces, making it lighter in weight than life saving ring buoys. The invention is assembled by threading a 12' 8" by ¼" UV protected polyester/nylon mix rope through one end cap, then a hollow noodle foam member, and out the other end cap attached to the other need of the foam member—sequentially, until all six members are held together. The rope is then tied and the knot is hidden within one foam member. There may be approximately ¾ inch sections of rope exposed and viewable at the corners of whichever configuration the raft is being used in; thus requiring the rope not be nylon alone but rather a mixture of polyester and nylon which will come UV protected and not stretch too much as nylon alone will do. The rope's tensile strength is a minimum of 1,100 pounds. The foam sections of the flyer will not break under any pressure normally used to employ Liquid Flyer in all its versatile configurations, because the strong crack and chip resistant urethane resin self locking end caps prevent the rope from tearing the foam members by keeping the rope on center of each foam member's ¾ inch hollow center; thereby making it impossible for the rope to tear through the ends and sides of the foam members.

Figure 1:
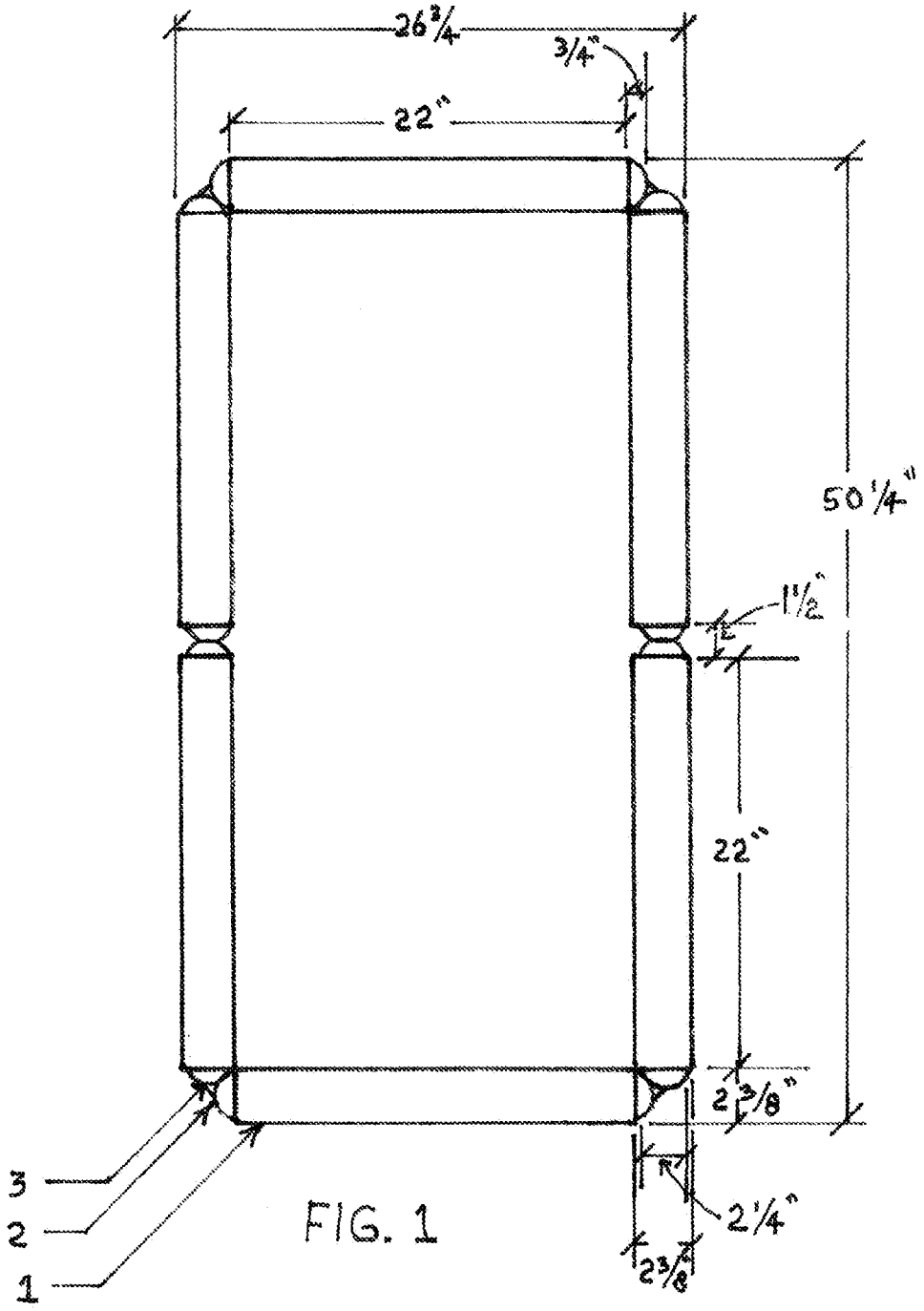
FIG. 1: | Basic Liquid Flyer with dimensions | Replacement Sheet |
|

The six members are comprised of water noodles that are—but not limited to—2⅜" in diameter, hollow with a ¾ inch center hole full length, and cut into 22" lengths FIG. 1 (1). There is nothing inflatable, so the device will not sink from puncture. The noodles will be purchased from a reliable vendor, such as Gladon, who manufactures consistently sized, buoyant, lightweight, unique closed cell polyethylene foam water noodles. Such noodles are UV, water, and mildew resistant, and are best stored out of sunlight to prevent color fading. They are highly resistant to water absorption and swimming pool chemicals. These noodles are CFC and HCFC free, and they bend and twist with rough use, allowing some abuse in handling. They are, however, impressionable; when tied with a bungee cord or rope, or stored bent, the dents will remain impressed in the foam and may never come out; hence, the six separate foam member design of Liquid Flyer allows for non damaging compact storage—while bending full length noodles would create permanent dent damage. Noodles come in various colors, so different colors are used to manufacture the Liquid Flyers. These noodle members support the weight of the user(s) in water. It is possible to intentionally rip the foam, but under normal use this will not occur. All foam members and all construction of Liquid Flyers are made in America to create American jobs, and for the purpose of having a higher quality than if they were made in China.

Figure 3:
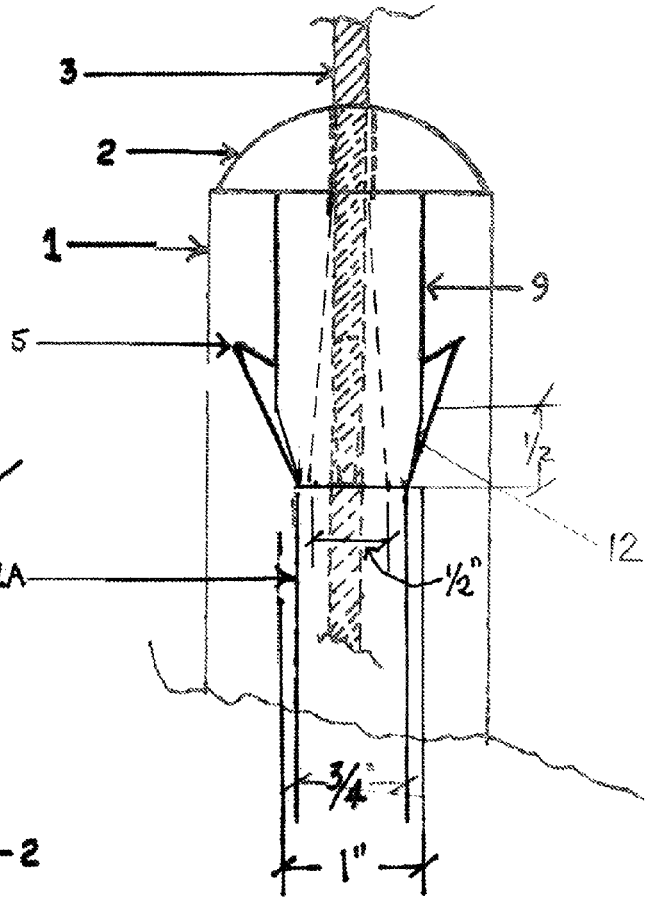
FIG. 3: | Cross section of end cap interior detail | Annotated Sheet |
|

The end caps, FIGS. 3 through 7, are key to the raft's stability and longevity, as they prevent the internal rope, FIG. 3 (3) from tearing into the ends of the foam noodles and then tearing open the length of the hollow noodle member body, FIG. 3 (1). The caps are resilient and will not crack or break if dropped on concrete, or if accidentally stepped on. In the event that the self locking end cap is pulled out, dislodged from the noodle, there are no sharp edges that could cause injury. The color of the UV protected urethane resin casting material is white, so the color cannot scratch or peel off.

The original end caps, FIG. 3 through 7, are manufactured in resin. Our prototypes are made with Smooth-On 300 Series White Urethane Resin. This material is mildew and solvent resistant (pool chlorine will not affect it), and UV resistant. The original prototype of this end cap was designed, sculpted, and molded by the inventor. The silicone rubber mold with its shell mold assures consistency of shape. (This process may be adapted in the future to use the technologies of vacuum forming or injection molding, or to use any newly developed resin-type or viable, utilitarian material that enhances the end cap performance or reduces its cost without compromise to its present integrity).

The end caps are created by pouring a two-part catalyst resin into a mold. After the resin solidifies, the end cap is removed from the mold. The over cast (extra material) is trimmed off, and the end caps are sanded. Twelve end caps are needed for each Liquid Flyer raft, (FIG. 1), one covering each end of six foam members. The smooth rounded caps are convex shape. The end caps are white in color and weigh 1.44 ounces, or 40.7 grams each. For clarity, the unibody end caps are described in two parts, the cap and the stem. (FIGS. 4, 5, & 6) illustrate the composition of the end caps.

The cap, FIG. 4 (10), FIG. 5 (10), and FIG. 7 (2) is 2⅛ inches wide by ¾ inch thick at its center, graduating down to ⅛-inch thickness rounded radius at its edge. It has a 5/16-inch diameter hole drilled on center, FIG. 7 (7).

The stem, FIG. 4 (9) and FIG. 5 (9), is 2 inches long by 1 inch wide exterior diameter, which tapers down to ¾ inch wide from last half inch of bottom of stem FIG. 4 (12). The stem is hollow, with its inside hole telescoping from a 5/16 inch dilemma at cap top to ½ inch diameter at its base. FIG. 4 (8 & 11). At the base of the exterior of the stem are four teeth FIG. 5 (5) that are ⅞ inch long, graduating from 1/16 inch deep at the base, FIG. 6 (5), of the stem up to ¼ inch deep at the top, FIG. 6 (5) of the tooth closest to the cap. At the top of each tooth there is a 30-degree angle, FIG. 4, from the top of each tooth to the stem, allowing each tooth to have a point for the purpose of biting into the foam noodle. The widths of the teeth are ¼ inch at the top graduating down to ⅛ inch wide at their bases, FIG. 4 (5). They are placed at 0 degrees, 90 degrees, 180 degrees, and 270 degrees, FIG. 6 (5), of the 360-degree circular shaft stem. The teeth are designed so that when the cap is pushed into the end of the noodle and slightly turned FIGS. 3 & 2, they grab the foam and prevent the end caps from being easily dislodged without the need for adhesive; especially needed because there is no adhesive to date that will adhere to both closed cell polyethylene foam and urethane resin and remain in tact under all applied uses such as in hot tubs and under the heat of the sun, FIG. 3.

From years of testing prototype models in all uses the teeth have proven to be adequate without the need for adhesive to hold the self-locking end cap lodged into the noodle member. With the diameter of the shaft of the end caps at 1 inch, FIGS. 3 (9), pressed into the ¾ inch center hole of the noodle, FIG. 3 (1A), that stretch also helps keep the end cap fixed within the foam noodle.

Figure 2:
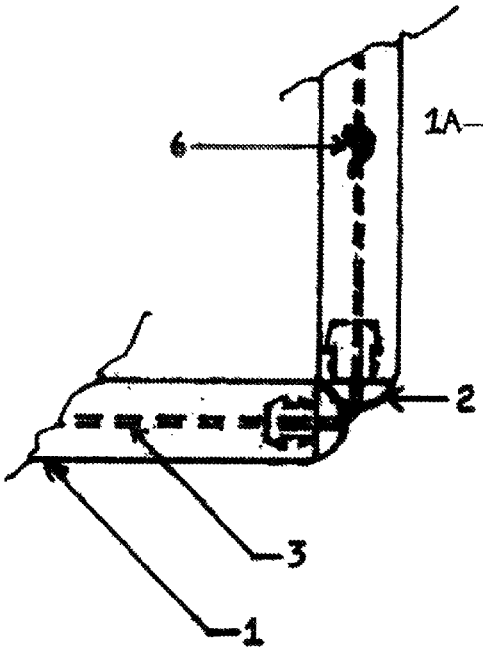
FIG. 2: | Cross section of interior corner detail | Annotated Sheet |
|

A length of waterproof, UV protected polyester nylon industrial rope, FIG. 3 (3) and FIG. 2 (3), white in color, of ¼ inch diameter, is cut to a length of 12-foot 8-inches and a knot is tied at the exact measured and marked points, FIG. 2 (6), and held within one of the foam sections to give the rope the appearance of a seamless construction. This is the length for our primary design only and may vary according to the different sized Liquid Flyers that might eventually be made.

Two 2¾" length carabiner clips (fasteners), FIGS. 14 & 16 & 20 (4) come attached to the rope between end caps, allowing the raft to be joined in a variety of configurations. The carabiner clips are spring loaded for easy open and close action and have spring steel split rings. They are typically constructed of anodized aluminum and in various colors and are readily available and will not rust. The carabiner clips provided can also be simultaneously used to hold a water bottle—to hydrate people, FIG. 14 (4 &13), or a container of sun lotion, or a tie down rope. The carabiner clips also provide a way to keep the raft held in a triangular configuration, FIG. 8 (4), to make it easier to toss the raft the needed distance to aid a water rescue victim.

With the figure eight configuration that the clips create, one person may put his/her feet on one end and his/her head on the other end, with the clipped cross-section above the belly keeping the body fully submerged in the water, providing a tighter unit. This shortens the length of the raft, taking up less space in a pool or hot tub. The figure eight configuration also serves to float a person above the water by placing the clipped sections below the back, rather than over the belly. Two people, with each person employing one of the circular loops, can also use the figure-eight configuration, FIG. 16, as one would use a round swimming tube, while being joined together. This is particularly useful for parent and child, romantic couples, friends, or people in rehabilitation.

The Liquid Flyer is used in a triangular configuration, FIGS. 8 and 9, for life saving purposes. The advantage of the Liquid Flyer over a ring buoy (standard life saver) for these purposes is that the Flyer can support three people, rather than just one; it takes up less storage space than three buoys; it weighs less; and costs less. The triangle configuration is also a substitute for swimming tubes or inner tubes, while it has the advantage of being puncture free and won't deflate, hence it is safer for these purposes.

The rectangle configuration allows a variety of uses. 1) Floaters can lay supine, keep their faces above water with their ears below water to muffle out all exterior sounds that could interfere with a peaceful, silent meditation, when used as a meditation raft. Arms will float comfortably below, creating no gravitational stress on the arms; which could normally interfere with one's ability to let go into a meditative state. Alternatively, arms can rest comfortably on top of the side members of the Liquid Flyer. 2) The rectangle configuration is also used for a variety of exercises prescribed in the inventor's authored book, *Meditations in Water*. When not used as a meditation raft or for these prescribed exercises, a person can also lie prone. 3) The most unique aspect of the rectangular configuration, besides allowing the body to float horizontally under water, is that two people, FIG. 20, can use it together and even massage each other's feet as an added benefit. 4) This configuration will also allow for the floating of objects, such as a cooler chest when floating down a river.

When in the shape of a rounded hexagon, the Liquid Flyer can be used by more than two people, FIG. 15. For example, a husband and wife can face each other with one or two small children diagonally across their laps. Another use of this configuration is for a prescribed Circle of Life Meditation, as mentioned in *Meditations in Water*. Up to six people can float on their backs on the outside of the hexagon by each person placing the backs of their ankles on one member of the hexagon.

When folded in half, with three sections on top of three sections, and moved into a U-shape, open arm-chair configuration, FIGS. 10 and 11, Liquid Flyer serves for the prescribed active meditations (exercises) as described in *Meditations in Water* book. When in the closed-arm-chair position—a square with a single member on each of three sides and three members on the forth side—it can be used for relaxation, meditation, recreation or life saving for one person while "keeping the ears out of the water."

When folded in half, with two rows of three foam members held side by side, FIG. 14, there are a variety of uses that this configuration can be employed for, including but not limited to: 1) for life-saving purposes, for approximately three people whose maximum weight does not exceed 500 pounds; and 2) for various exercises as indicated in *Meditations in Water*.

Figure 22:
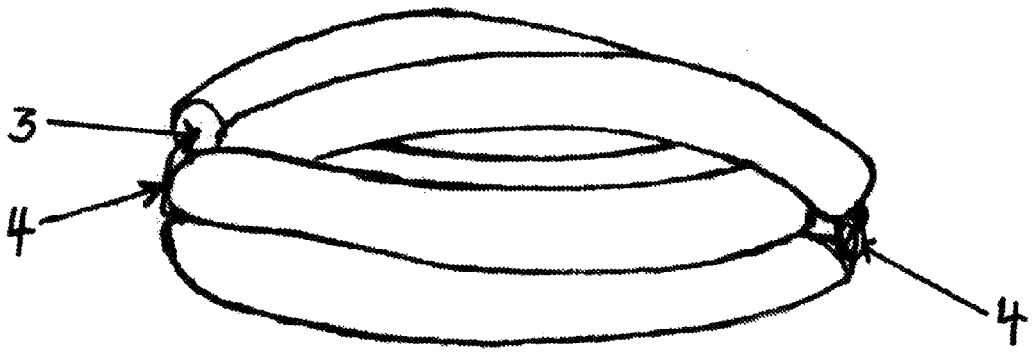
Figure 23:
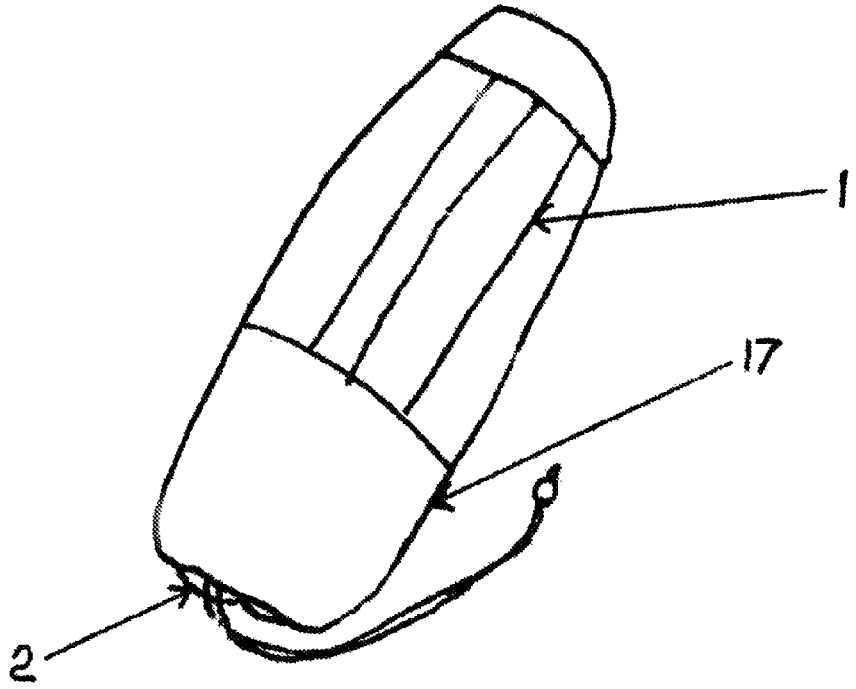

When Liquid Flyer is closed, with all six members held side by side by the two carabiner clips fastened at both ends of all six members FIG. 22, or in its tote bag FIG. 23, Liquid Flyer serves as a pillow on dry land or in boats.

CONCLUSION

My invention titled, "Liquid Flyer Flexi Underwater Raft" (AKA Liquid Flyer) is exactly as its title states: It is an original, multi-functional, convertible (="Flexi"—as in flexible) non inflatable, open-centered raft (no solid platform) that will float one and more people with their entire bodies fully submerged ("Underwater Raft")—with only their heads and feet, or faces and toes (as desired) exposed. Their bodies remain floating naturally due to the buoyancy of the water, while fully submerged "in" the water, rather than "on top of the water." All conventional inflatable pool rafts float people "on top of the water," leaving their bodies exposed to the elements and to the public display of their bodies—not desirable by most people with heavier bodies too self conscious to put themselves on such display in a bathing suit. Liquid Flyer keeps people's bodies comfortably and privately submerged in the water. With just their heads and feet atop the two ends of the six member Liquid Flyer Raft, there is actually little load on the raft, because it is not required to support the full weight of a body being supported by the natural buoyancy of the water.

The multi-functional aspect of Liquid Flyer (being a flexi or convertible raft) is accomplished by creating a "variety of configurations" that the engineered six foam member Liquid Flyer can create—created by using the two 2¾ inch (size) attached carabiner clips. Some configurations allow people to float on top of as well as under the water, while others are used for a variety of applied uses, including, but not limited to: Recreation, Relaxation, Aquatic Exercise, Physical Therapies, Life Saving and a variety of Original Active & Inactive Meditations Done in Water, as prescribed in the book authored by Liquid Flyer's inventor—Jeffrey Ashi Olshan, titled *Meditations in Water*—the first book of its kind introducing a new form of healing arts—meditations in water. Liquid Flyer is offered as the companion to the soon to be published *Meditations in Water* book (scheduled to be published in August 2015). Both the book and its companion, Liquid Flyer, make significant and important contributions to the healing arts by creating a whole new form of healing arts to help people with a variety of medical (physical and mental) needs while providing preventative health care as well.

Liquid Flyer was designed to be employed in all comfortable and safe temperature bodies of water, including: Bath Tubs, Hot Tubs, Pools, Lakes, Rivers and Oceans—ranging from approximately 70 degrees to 110 degrees in temperature. It was also designed as a better life saver than the standard ring buoy, having seven advantages over the life buoy: 1) Costs less, 2) Lighter weight, 3) Needs less storage space, 4) Can float "unconscious" rescue victims until rescued—not requiring them to hold on, 5) Can float people above or below water as needed for exposure safety, 6) Safer to toss because it cannot render rescue victims unconscious if they are accidentally hit in the head or neck by the tossed Liquid Flyer, while a ring buoy could render someone unconscious if hit by it, and 7) because Liquid Flyer is versatile, not just employed for life saving, it is more desirable to have on private boats, ships, cruise ships and yachts. Liquid Flyer should also be appealing to people going on cruise ships—given some recent cruise ships capsizing—to have as their own personal supplemental life saver, as well as it being a recreation device to be enjoyed in the ship's pools and hot tubs.

In addition to the unique and novel aspects of this engineered six member convertible, multi-functional underwater raft, and all the areas it serves—for both health and recreation purposes—the other novel aspect of this invention is what allows it all to work without destructing from normal use. With its six closed-cell polyethylene foam members being too vulnerable to withstand a rope being pulled against them without tearing—from its internal ¼ inch UV polyester/nylon rope stringing its six 22 inch long foam members together—I invented a novel self-locking insertable end cap that, when inserted into each end of the six members (12 caps per raft), prevents the rope from tearing through the foam members by keeping it centrally located in the middle of each hollow foam member. Because I could not find any adhesive that could adhere to both the urethane resin end caps and the closed cell polyethylene foam members and stay fixed—in both cold and hot water—I had to devise a "self-locking end cap" design, that allows the end caps to remain fixed in the foam member ends under all normal use in all bodies and temperatures of water. The success of the self-locking end caps remaining intact and not becoming dislodged from normal use has been proven from seven years of experimentation, research and development with more than a dozen prototypes of Liquid Flyer used by a variety of people, deploying all of Liquid Flyer's noted configurations discovered thus far.

Liquid Flyer is being sold with a waterproof tote bag to keep it contained for minimum storage space, protect it from being soiled, and for travel—easily carried and checked or carried on airliners or cruise ships.

Last, but not least, Liquid Flyer will not be jobbed out to be manufactured in other countries—such as China—so it may contribute to creating needed jobs for American workers in America. This dedication to both quality control and the author/inventor's devotion to help America recover from corporate sell-out of the American worker, will hold true whether the inventor chooses to manufacture and sell it directly, or if it is licensed to some other manufacturer to manufacture and sell. I, Jeffrey Ashi Olshan, stand strong to this commitment, no matter what price Liquid Flyer needs to be sold for, to accommodate this desire.

I claim:

1. A multi-functional convertible underwater raft; for use by one or more people in all bodies of water; comprising: a non-inflatable foam member hollow raft that allows one or more people to float fully submerged in water; a foldable frame structure further capable of being folded into a compact light weight storage configuration; the foldable frame structure comprising non-inflatable foam members made from cut sections of closed-cell polyethylene; a rope to tie the foam members together; self-locking end caps with one at each end of the foam members to prevent the rope from tearing through the foam members under pressure; two carabiner clips used for the purpose of creating different configurations of the convertible underwater raft for multi-functional uses; wherein equal lengths of closed-cell polyethylene foam members are cut; that possess the ability to float without inflation; each self-locking end cap is made of cast UV protected white urethane resin, each self-locking end cap is comprised of a hollow stem of a 1 inch exterior diameter tapered down at the bottom of the stem for easier threading into the hole in the foam members, the self-locking end caps are designed to protect from tearing, wherein the self-locking end cap is circular with a curved top attached to the non-tapered end of the stem; leaving the tapered end of the hollow stem open to run the rope through; the self-locking end cap is held in place in the foam members by four teeth attached to the stem; held in place by fully inserting the stem of the end caps until the top of the self-locking end cap is firmly against the end of the foam member; where the self-locking end cap is then rotated a ¼ turn to a locked position to prevent dislodgment.

* * * * *